US011043109B2

(12) United States Patent
Matsuda et al.

(10) Patent No.: US 11,043,109 B2
(45) Date of Patent: Jun. 22, 2021

(54) FIRE NOTIFICATION FACILITY

(71) Applicant: HOCHIKI CORPORATION, Tokyo (JP)

(72) Inventors: Yoshihiro Matsuda, Tokyo (JP); Shigeru Kaneko, Tokyo (JP); Takehiro Ono, Tokyo (JP); Akira Ishida, Tokyo (JP)

(73) Assignee: HOCHIKI CORPORATION, Tokyo (JP)

( * ) Notice: Subject to any disclaimer, the term of this patent is extended or adjusted under 35 U.S.C. 154(b) by 0 days.

(21) Appl. No.: 16/795,993

(22) Filed: Feb. 20, 2020

(65) Prior Publication Data

US 2020/0184801 A1 Jun. 11, 2020

Related U.S. Application Data

(63) Continuation of application No. PCT/JP2019/001571, filed on Jan. 21, 2019.

(30) Foreign Application Priority Data

Jan. 22, 2018 (JP) ..... JP2018-007889

(51) Int. Cl.
*G08B 25/04* (2006.01)
*G08B 17/10* (2006.01)
*G08B 29/06* (2006.01)

(52) U.S. Cl.
CPC ..... *G08B 25/04* (2013.01); *G08B 17/10* (2013.01); *G08B 25/045* (2013.01); *G08B 29/06* (2013.01)

(58) Field of Classification Search
CPC ..... G08B 25/04; G08B 17/10; G08B 29/06; G08B 25/045
USPC ..... 340/501
See application file for complete search history.

(56) References Cited

U.S. PATENT DOCUMENTS 4,068,105 A * 1/1978 Jain ..... G08B 25/04 714/43
7,142,093 B2 * 11/2006 Foster ..... G08B 3/10 340/286.05
7,741,848 B1 * 6/2010 Olsson ..... G01V 3/102 324/326

FOREIGN PATENT DOCUMENTS

| | | |
|---|---|---|
| JP | 06-259688 | 9/1994 |
| JP | 08-44984 | 2/1996 |
| JP | 08-336192 | 12/1996 |
| JP | 2008-004033 | 1/2008 |
| JP | 2010-114632 | 5/2010 |

* cited by examiner

*Primary Examiner* — John A Tweel, Jr.
(74) *Attorney, Agent, or Firm* — Wenderoth, Lind & Ponack, L.L.P.

(57) ABSTRACT

A fire detector is connected to a loop transmission path connected to a receiver. When the loop transmission path is normal, a communication connection is made from a transmitting unit to the fire detector to monitor fire. When a break fault occurs in the loop transmission path, a break monitoring control unit turns switching circuit units ON to connect a termination of the loop transmission path to the transmitting unit. To the loop transmission path, a relay detects a current normal direction at normal and a current reverse direction at the time of occurrence of a break for transmission to the receiver. When a break occurs in the loop transmission path, a break section determining unit of the receiver determines, as a break section, a section in which the current normal direction detected by a plurality of the relays is changed to the current reverse direction.

11 Claims, 10 Drawing Sheets

[FIG. 1]
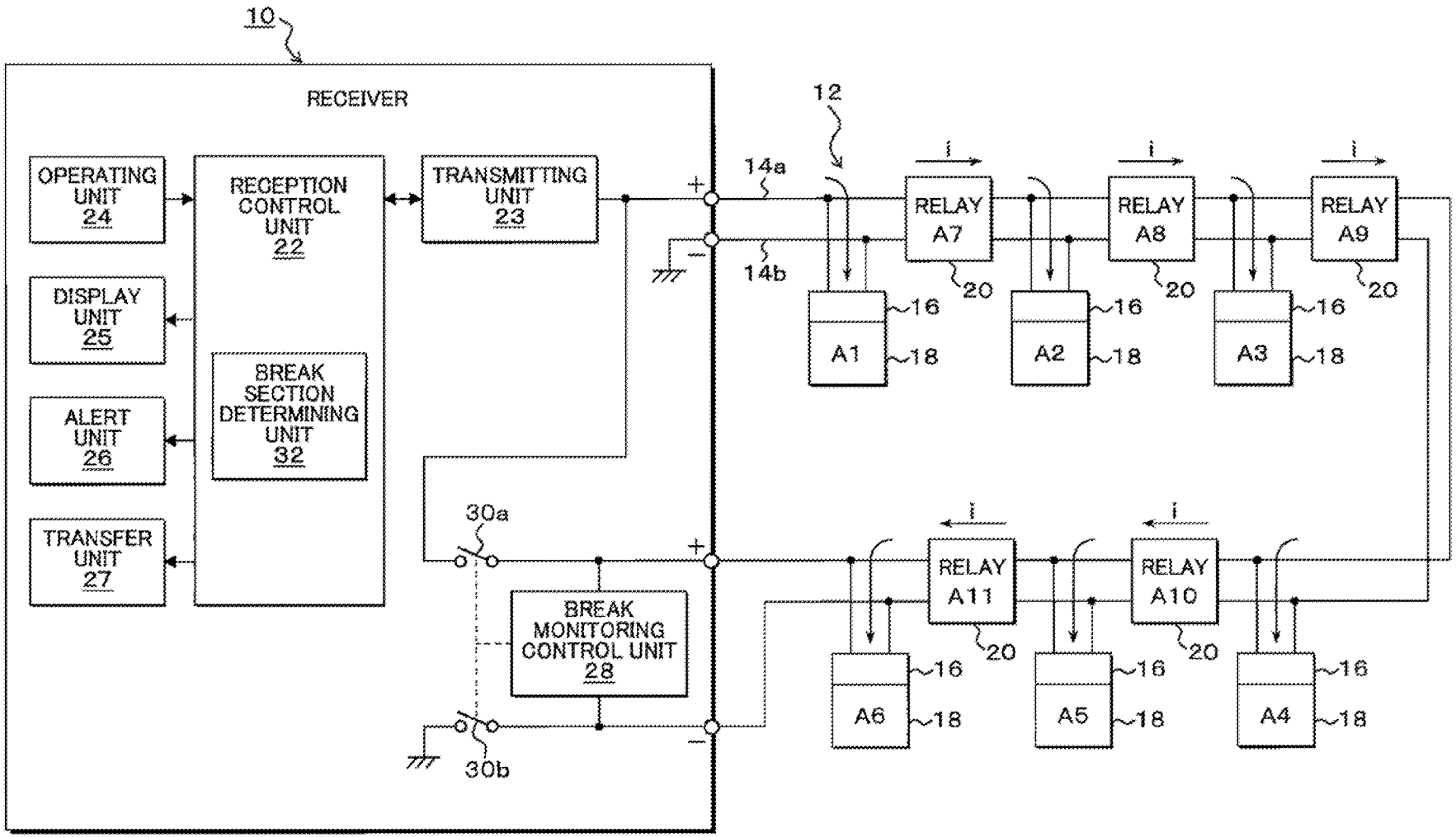

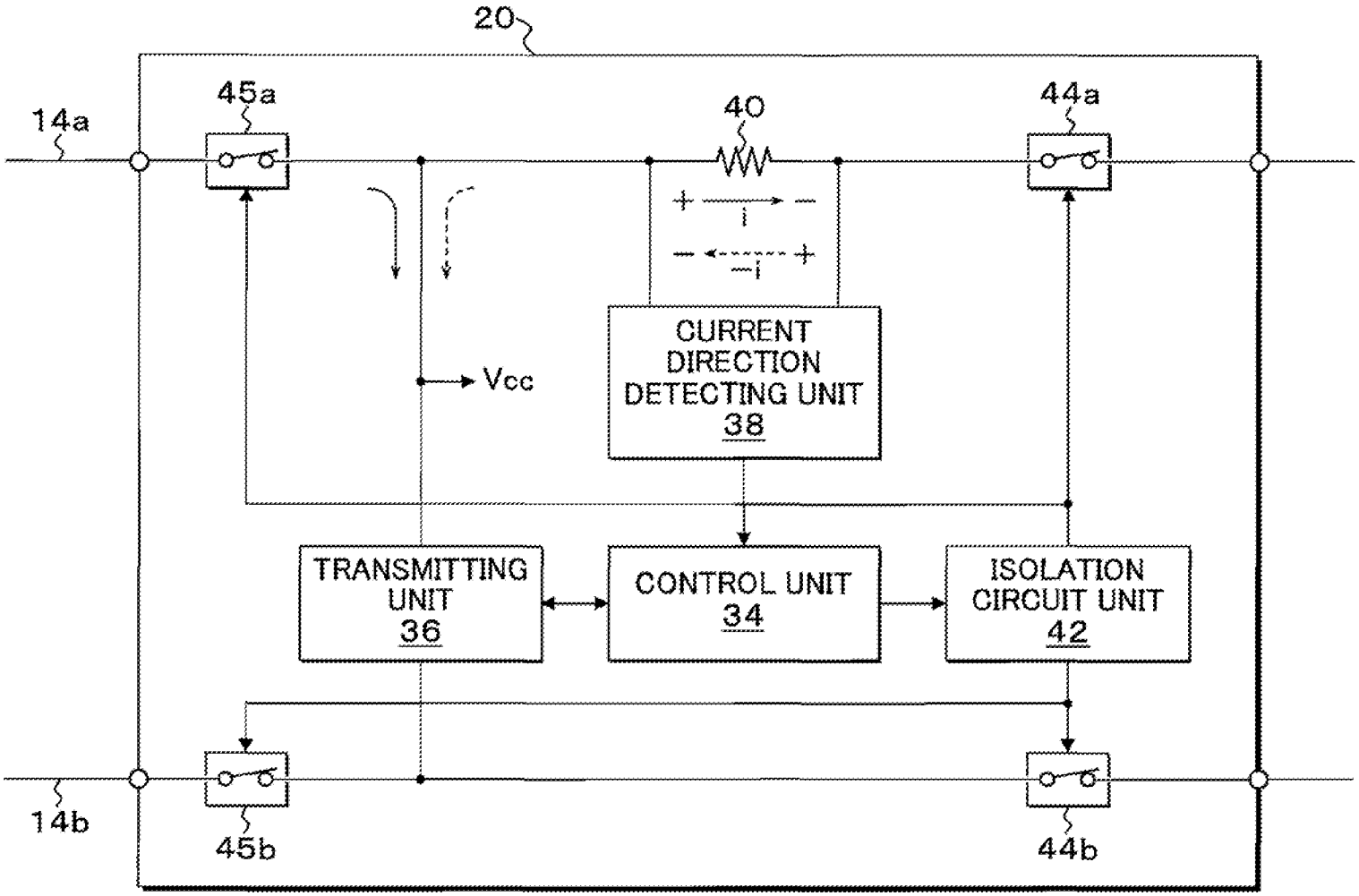
[FIG. 2]

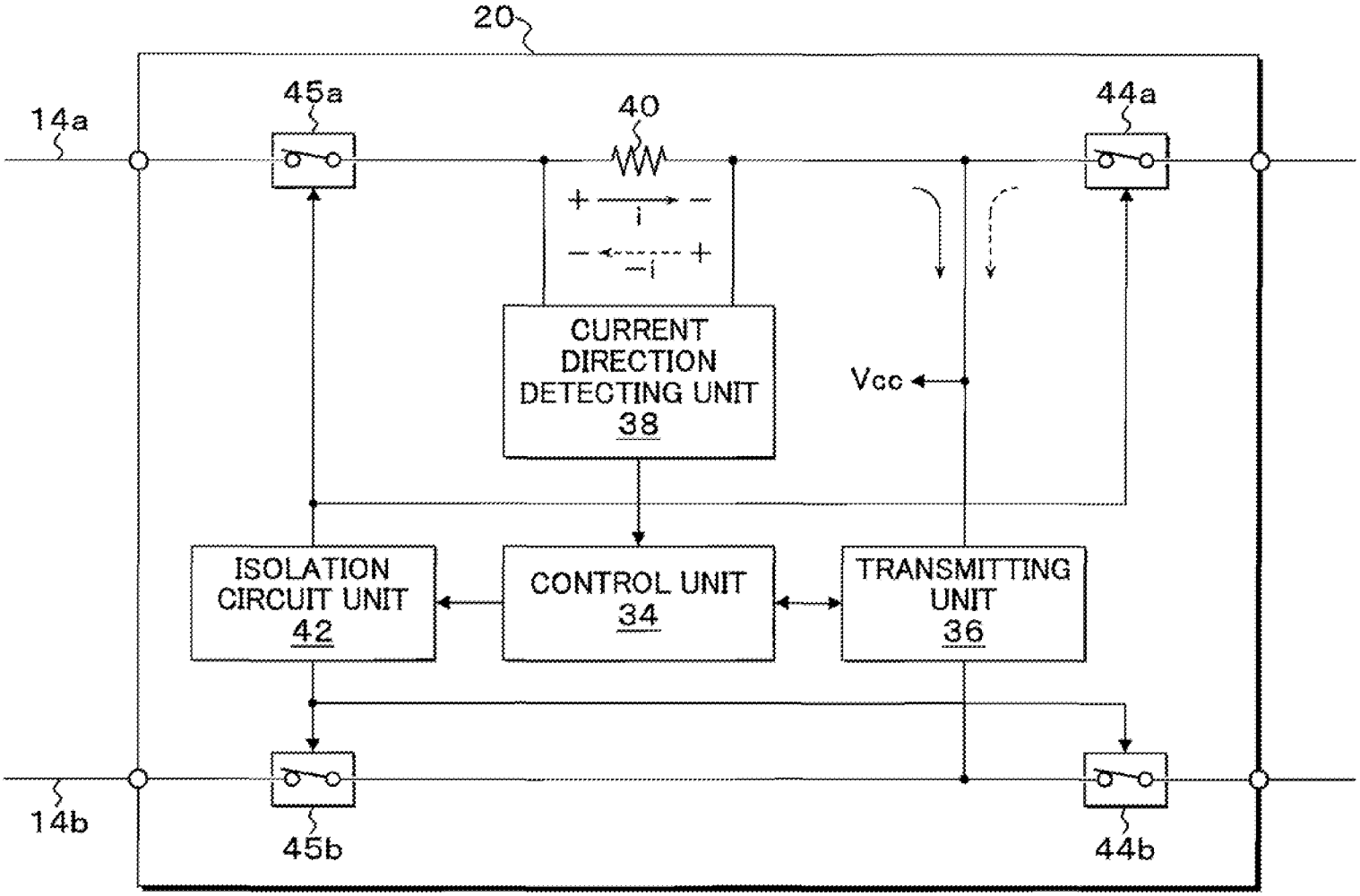
[FIG. 3]

[FIG. 4]
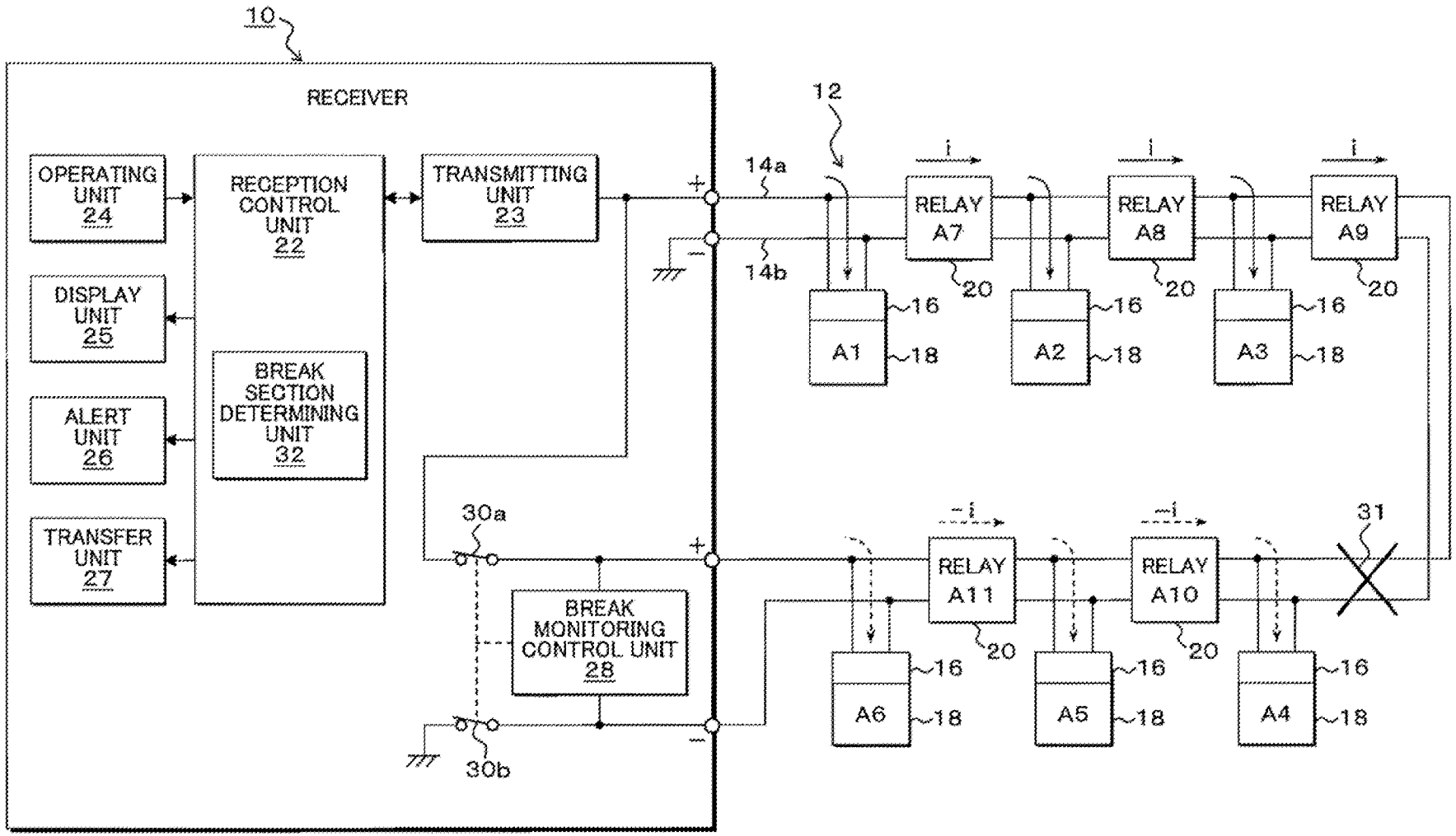

[FIG. 5]
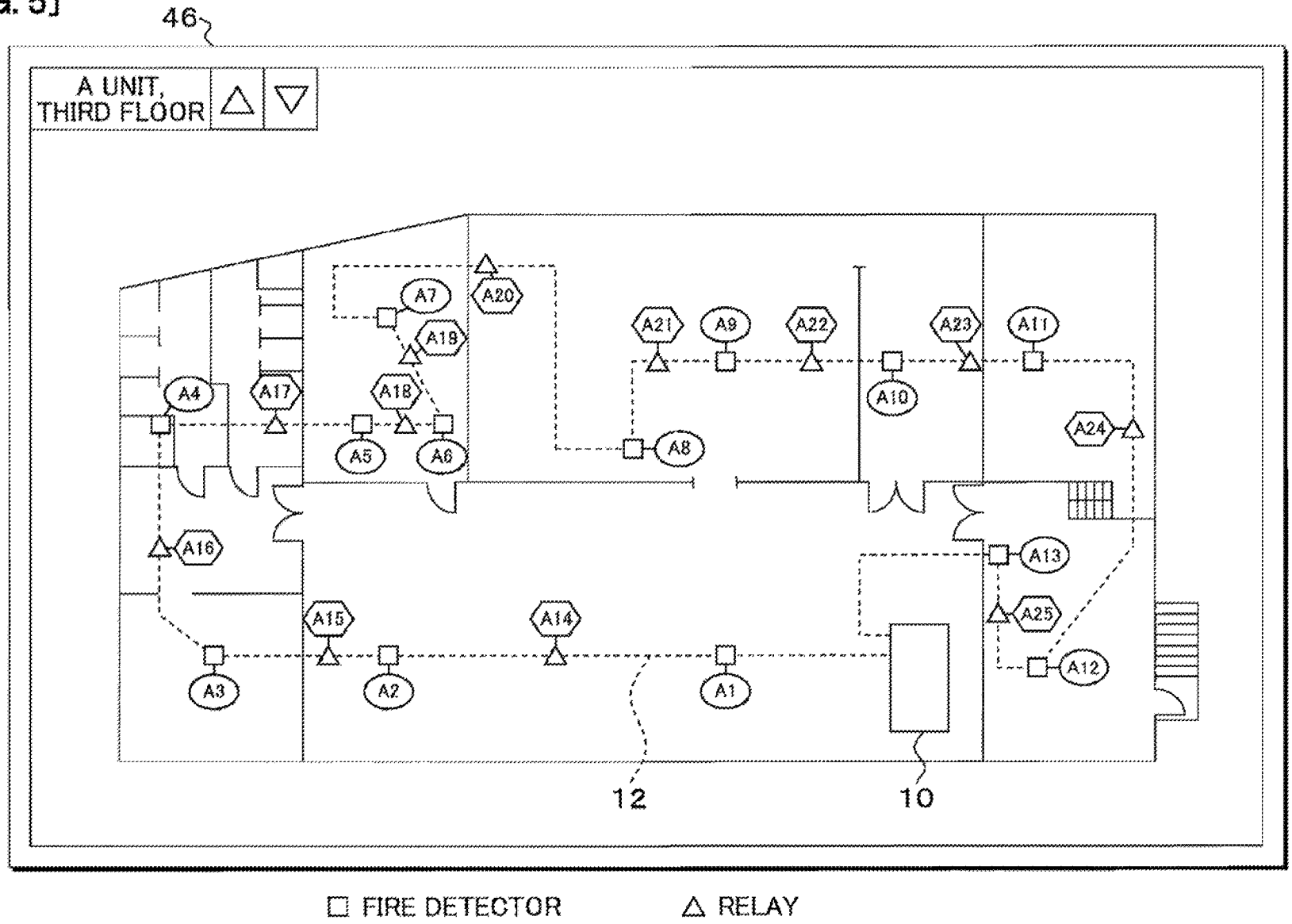

[FIG. 6]
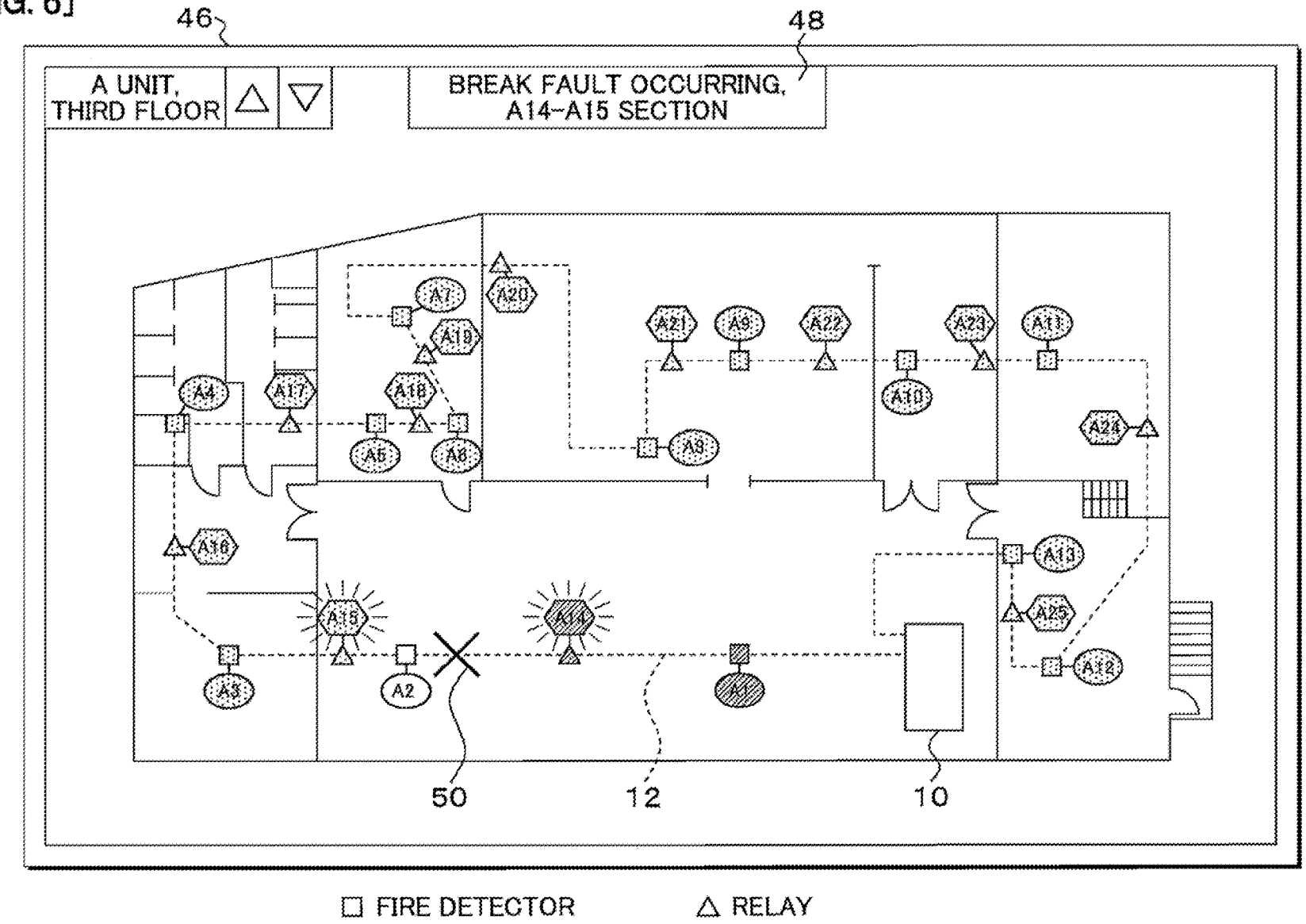

[FIG. 7]
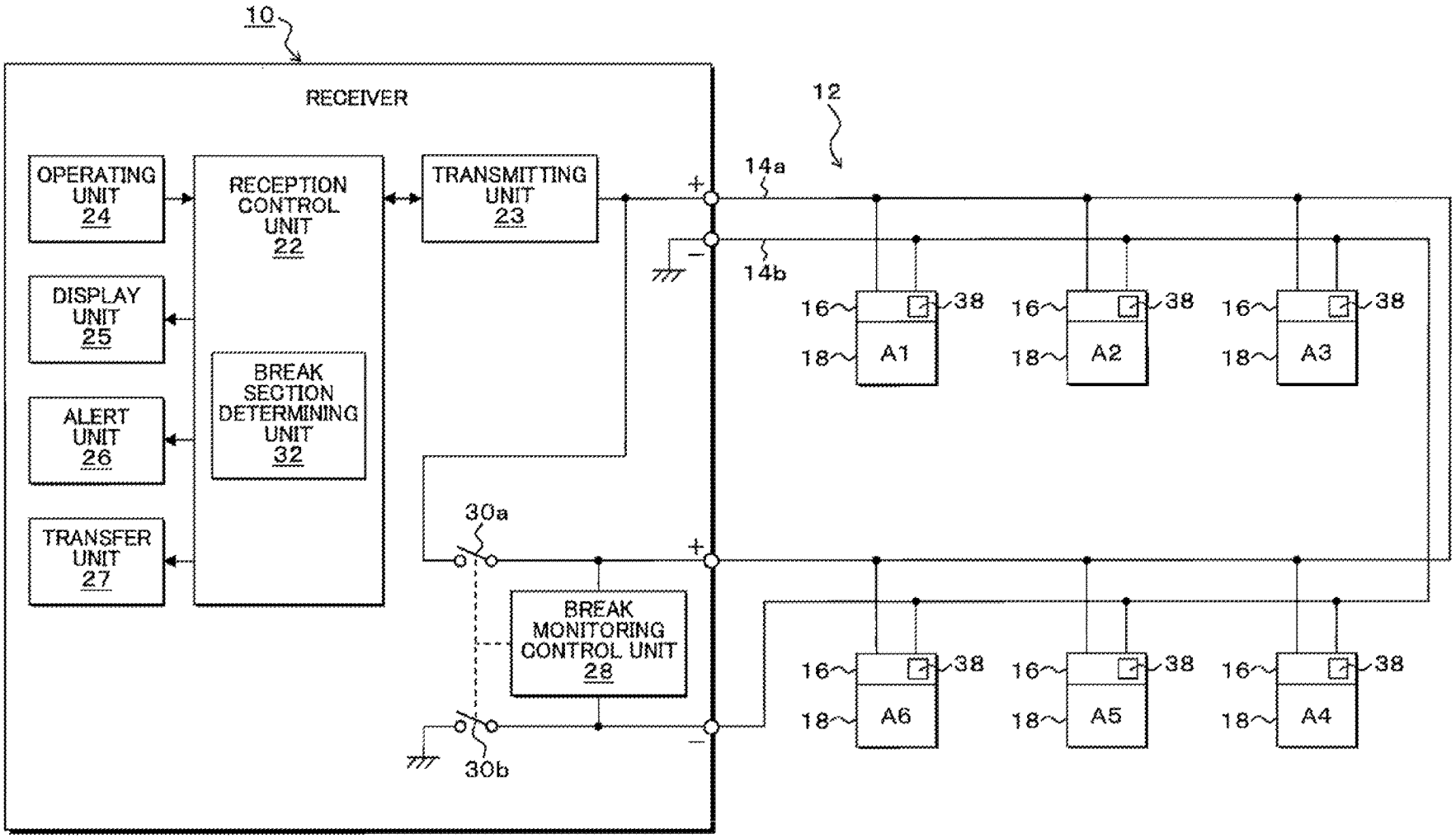

[FIG. 8]
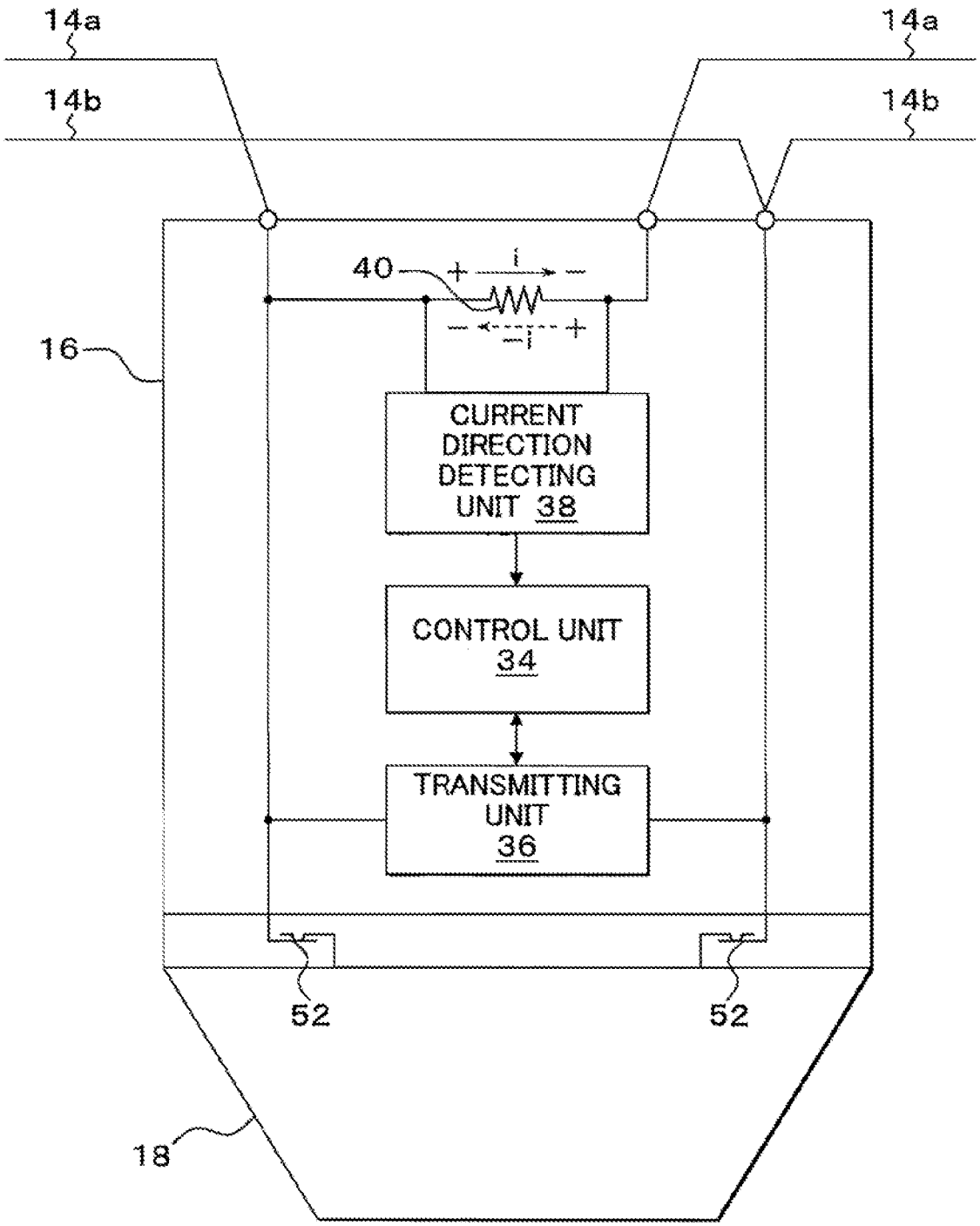

[FIG. 9]
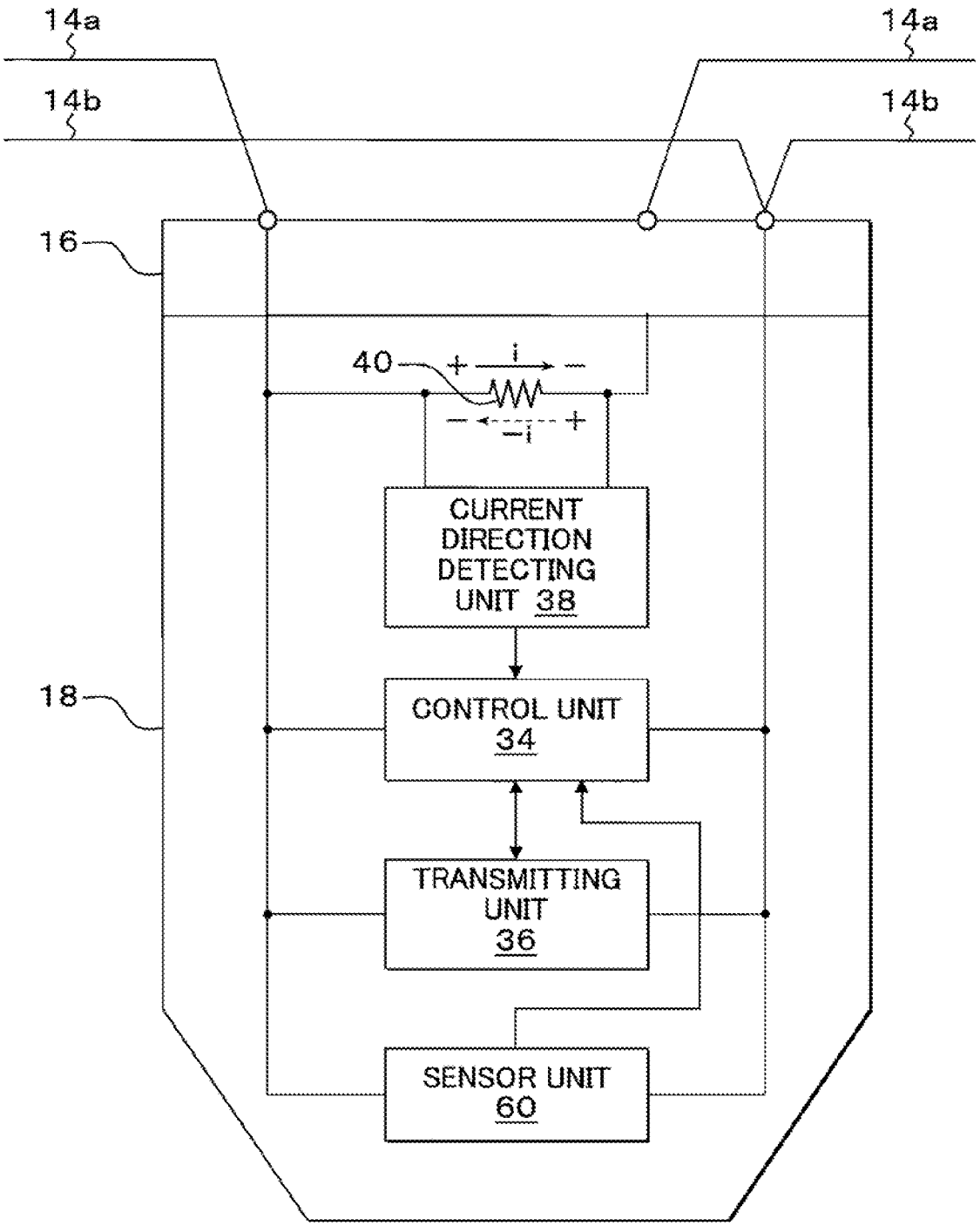

[FIG. 10] PRIOR ART
(A)
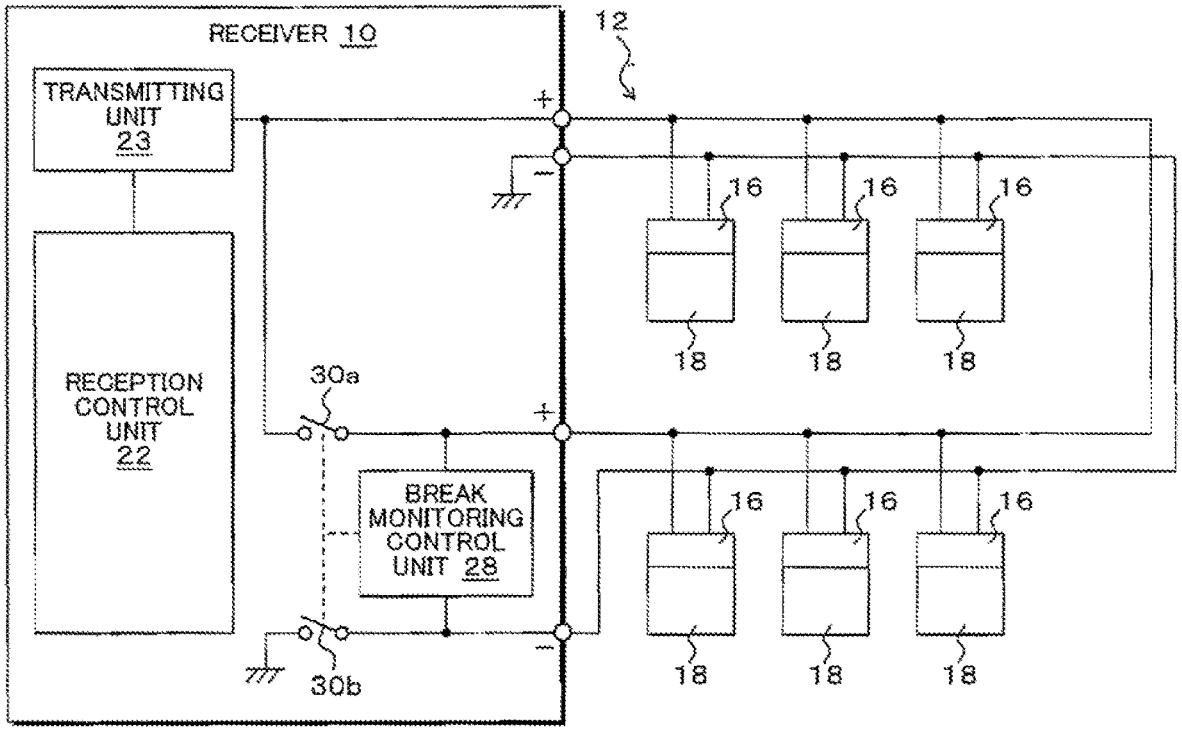
(B)
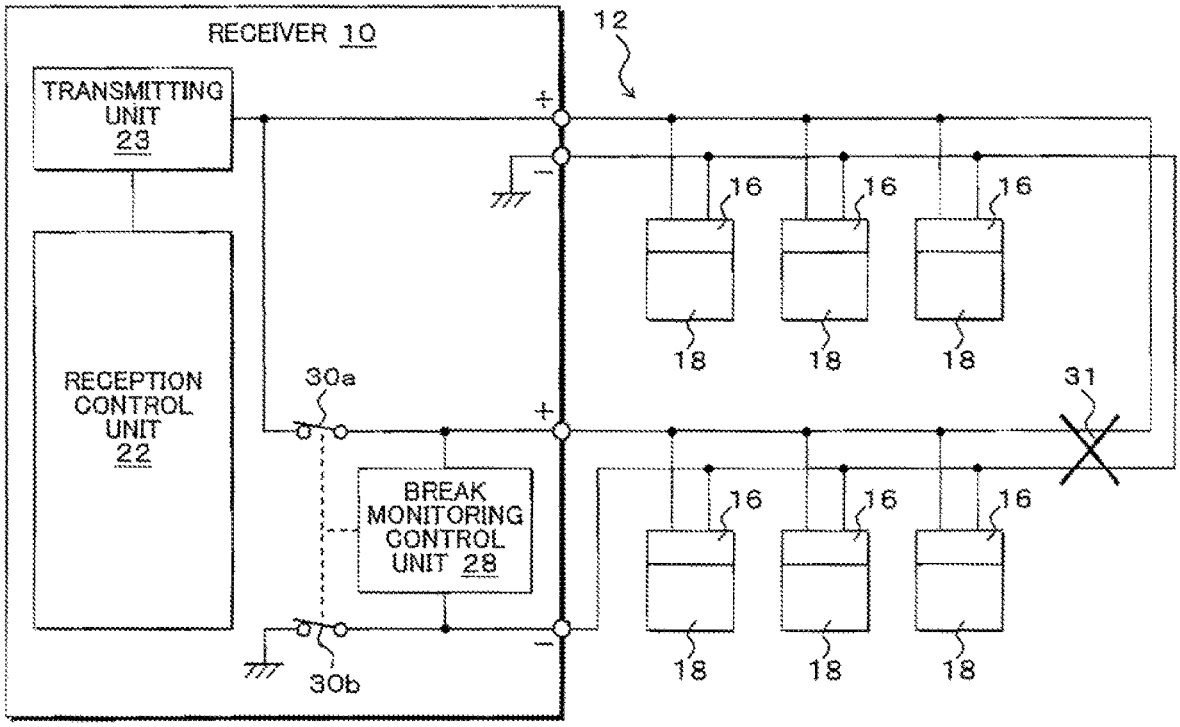

FIRE NOTIFICATION FACILITY

TECHNICAL FIELD

The present invention relates to a fire notification facility in which fire detectors are connected to a loop transmission path from a receiver to monitor fire.

BACKGROUND ART

Conventionally, in a fire notification facility known as an R type, terminal devices such as fire detectors each including a transmission function are connected to a transmission path drawn out from a receiver. At the time of detecting a fire, for example, based on a fire interrupt from the fire detector, a search command is issued to identify the address of a fire detector which issues a notification and display the fire-occurring address. Also, fire data is collected from the identified fire detector for monitoring.

In this manner, if the address of the fire detector which detects a fire is found, appropriate escape guiding and fire fighting can be performed. This is an indispensable function for fire monitoring particularly in large-sized facilities.

Also, to ensure reliability with respect to a break fault in the transmission path drawn out from the fire receiver, a fire notification facility has been known in which fire detectors are connected to a loop transmission path connected in a loop shape to the receiver to monitor fire.

FIG. 10 is a descriptive diagram of a conventional fire notification facility using a loop transmission path, in which a normal monitoring state is depicted in FIG. 10(A) and a case in which a break fault occurs is depicted in FIG. 10(B).

As depicted in FIG. 10(A), a transmission path 12 using paired signal lines are drawn out from a transmitting unit 23 provided to a receiver 10. The transmission path 12 is arranged in a loop shape of being drawn out from the receiver 10 and then returning to the receiver 10 again. In the following description, the transmission path 12 connected in a loop shape to the receiver 10 is referred to as a loop transmission path 12.

Between the signal lines of the loop transmission path 12, fire detectors 18 each including a transmitting function are attachably and detachably connected via detector bases 16. To each fire detector 18, a unique detector address is set. With a downstream signal for changing a line voltage being transmitted from a transmitting unit 23 and an upstream signal for changing a line current being transmitted from any fire detector 18, fire is monitored.

At the termination of the loop transmission path 12 drawn into the receiver 10, a break monitoring control unit 28 is provided, monitoring a break fault in the loop transmission path 12 based on the line voltage supplied from the transmitting unit 23 to the loop transmission path 12. Also, at the termination of the loop transmission path 12, switching circuit units 30*a* and 30*b* are provided which perform switching connection of the signal line at the termination to the transmitting unit 23. In a normal monitoring state, the switching circuit units 30*a* and 30*b* render the transmitting unit 23 as being in an insolation state.

As depicted in FIG. 10(B), during operation, if a break 31 occurs in the course of the loop transmission path 12, the break monitoring control unit 28 detects a break fault because the line voltage at the termination of the loop transmission path 12 is interrupted to activate the switching circuit units 30*a* and 30*b*, and connects a termination side of the loop transmission path 12 to the transmitting unit 23.

Thus, a signal from the transmitting unit 23 is transmitted via the switching circuit units 30*a* and 30*b* from the termination side of the loop transmission path 12 toward the location of occurrence of the break 31, allowing signal transmission and reception to and from the fire detector 18 connected between the location of occurrence of the break 31 and the termination of the loop transmission path 12. If a break fault occurs, the fire monitoring function by the fire detectors 18 connected to the loop transmission path 12 is not lost, and high reliability can be acquired.

RELATED ART DOCUMENTS

Patent Document 1: Japanese Patent Application Publication No. 2008-004033; and

Patent Document 2: Japanese Patent Application Publication No. 2010-114632.

DISCLOSURE OF INVENTION

Problems to be Solved by the Invention

However, in the conventional fire notification facility as described above, as depicted in FIG. 10(B), when the break 31 occurs in the course of the loop transmission path 12, the break monitoring control unit 28 detects a break fault and causes the switching circuit units 30*a* and 30*b* to connect the termination side of the loop transmission path 12 to the transmitting unit 23 for signal transmission from both sides of the break location to the loop transmission path 12. Thus, the fire monitoring function by the fire detectors 18 connected to the loop transmission path 12 is not lost. However, there is a problem in which the receiver 10 cannot detect where the break occurs in the loop transmission path 12 and it takes time and effort until the break location is found for recovery.

An object of the present invention is to provide a fire notification facility which allows a break section to be easily found on a receiver side when a break occurs in a loop transmission path and signal transmission is allowed from both sides of the location of the break to continue fire monitoring.

Means for Solving the Problems (Fire Notification Facility)

The present invention is characterized in that, in a fire notification facility in which: a fire detector is connected to a loop transmission path connected in a loop shape to a receiver or a relay connected to the receiver; when the loop transmission path is normal, a signal is transmitted from a transmitting unit of the receiver or relay connected to a starting end of the loop transmission path to the fire detector to monitor fire; and when a break occurs in the loop transmission path, a termination of the loop transmission path is connected to the transmitting unit to transmit a signal from both ends of the loop transmission path to the fire detector to monitor fire, a current direction detecting unit is provided which is connected to the loop transmission path, has a unique address set thereto, detects a current direction flowing through the loop transmission path in a predetermined direction as a current normal direction and detects a current flowing through a direction opposite to the current normal direction as a current reverse direction.

(Detection of Current Direction by Current Detection Resistor)

The current direction detecting unit detects a current detection voltage by a current flowing through a current detection resistor connected in series to the loop transmission path, detects the current normal direction when the current detection voltage is a plus voltage or zero volt when a power supply voltage is supplied to the current direction detecting unit from an upstream side of the current detection resistor, and detects the current reverse direction when the current detection voltage is a minus voltage or zero volt when a power supply voltage is supplied to the current direction detecting unit from a downstream side of the current detection resistor.

(Relay Provided with Current Direction Detecting Unit)

A plurality of said current direction detecting units are provided to relays connected to the loop transmission path among the plurality of fire detectors connected to the loop transmission path.

(Detector Base Provided with Current Direction Detecting Unit)

The plurality of current direction detecting units are provided to detector bases which each attach ably and detachably connect the fire detector to the loop transmission path.

(Detector Provided with Current Direction Detecting Unit)

The current direction detecting unit is provided to the fire detector connected to the loop transmission path.

(Current Direction Detecting Unit Provided with Display Unit)

The current direction detecting unit includes a display unit which displays a current direction.

(Break Section Determining Unit)

A plurality of said current direction detecting units are provided to the loop transmission path to transmit the current direction to the receiver or the relay, and furthermore, a break section determining unit is provided to the receiver or the relay, the break section determining unit determines, as a break section, a section in which the current normal direction detected at the plurality of current direction detecting units is changed to the current reverse direction when a break occurs in the loop transmission path, and notifies as such.

(Color-Coding Display of Break Section)

The fire receiver causes a screen display of a disaster-prevention facility map where address arrangement of the loop transmission path and the plurality of current direction detecting units is displayed, and the break section determining unit causes a current normal group including one or a plurality of said current direction detecting units in which the current normal direction is detected and a current reverse group including one or a plurality of said current direction detecting units in which the current reverse direction is detected to be displayed by color coding with different predetermined colors, and causes occurrence of a break between the color-coded current normal group and current reverse group to be displayed.

(At-A-Glance Display of Detected Direction of Current Direction Detecting Unit)

The fire receiver makes an at-a-glance display with information for identifying the current direction detecting units and the current direction detected by the current direction detecting units associated with each other.

Effects of the Invention (Basic Effects)

In the present invention, in a fire notification facility in which: a fire detector is connected to a loop transmission path connected in a loop shape to a receiver or a relay connected to the receiver; when the loop transmission path is normal, a signal is transmitted from a transmitting unit of the receiver or relay connected to a starting end of the loop transmission path to the fire detector to monitor fire; and when a break occurs in the loop transmission path, a termination of the loop transmission path is connected to the transmitting unit to transmit a signal from both ends of the loop transmission path to the fire detector to monitor fire, a current direction detecting unit is provided which is connected to the loop transmission path, has a unique address set thereto, detects a current direction flowing through the loop transmission path in a predetermined direction as a current normal direction and detects a current flowing through a direction opposite to the current normal direction as a current reverse direction. Thus, the break section of the loop transmission path can be easily found, and repairment and replacement is quickly performed on the break location of the loop transmission path to allow the loop transmission path to be recovered to become in a normal state, thereby allowing facility reliability to be ensured.

(Effects of Detection of Current Direction by Current Detection Resistor)

Also, the current direction detecting unit detects a current detection voltage by a current flowing through a current detection resistor connected in series to the loop transmission path, detects the current normal direction when the current detection voltage is a plus voltage or zero volt when a power supply voltage is supplied to the current direction detecting unit from an upstream side of the current detection resistor, and detects the current reverse direction when the current detection voltage is a minus voltage or zero volt when a power supply voltage is supplied to the current direction detecting unit from a downstream side of the current detection resistor. Thus, when a break occurs in the loop transmission path on a downstream side or upstream side of any relay and a normal current or reverse current does not flow through the current detection resistor because a fire detector is not connected between the relay and the break location and the current direction detecting unit detects a current detection voltage of 0 volt, the current normal direction or the current reverse direction is detected, thereby making it possible to determine on which of the upstream side and the downstream side of the relay the break location occurs when the break detection voltage of 0 volt is detected.

(Effects by Relay Provided with Current Direction Detecting Unit)

Furthermore, the current direction detecting unit is provided to a relay connected to the loop transmission path among the plurality of fire detectors connected to the loop transmission path.

Thus, by detection of the current direction at the relay, a section of the relay in which the current normal direction is changed to the current reverse direction can be determined as a break section and a notification as such can be made.

(Effects by Detector Base Provided with Current Direction Detecting Unit)

Still further, the current direction detecting unit is provided to a detector base which attachably and detachably connects the fire detector to the loop transmission path. Thus, by detection of the current direction at the detector base, a section of the detector base in which the current normal direction is changed to the current reverse direction can be determined as a break section and a notification as such can be made.

(Effects by Detector Provided with Current Direction Detecting Unit)

Yet still further, the current direction detecting unit is provided to the fire detector connected to the loop transmission path. Thus, by detection of the current direction at the detector, a detector section in which the current normal direction is changed to the current reverse direction can be determined as a break section and a notification as such can be made.

(Effects by Current Direction Detecting Unit Provided with Display Unit)

Yet still further, the current direction detecting unit includes a display unit which displays a current direction. Thus, when a break occurs, the operator advances in the wiring direction while checking the display unit of the terminal including the current direction detecting unit and can thereby grasp a section in which the current normal direction is changed to the current reverse direction as a break section.

(Effects of Break Section Determining Unit)

Yet still further, a plurality of said current direction detecting units are provided to the loop transmission path to transmit the current direction to the receiver or the relay, and furthermore, a break section determining unit is provided to the receiver or the relay, the break section determining unit determines, as a break section, a section in which the current normal direction detected at the plurality of current direction detecting units is changed to the current reverse direction when a break occurs in the loop transmission path, and notifies as such. Thus, the break section of the loop transmission path can be easily found on a receiver side, and repairment and replacement is quickly performed on the break location of the loop transmission path to allow the loop transmission path to be recovered to become in a normal state, thereby allowing facility reliability to be ensured.

(Effects by Color Coding Display of Break Section)

The fire receiver causes a screen display of a disaster-prevention facility map where arrangement of the loop transmission path and the plurality of current direction detecting units are displayed, and the break section determining unit causes a current normal group including one or a plurality of said current direction detecting units in which the current normal direction is detected and a current reverse group including one or a plurality of said current direction detecting units in which the current reverse direction is detected to be displayed by color coding with different predetermined colors, and causes occurrence of a break between the current normal group and the current reverse group color-coded. Thus, when a break occurs in the loop transmission path, for example, a disaster-prevention facility map with the loop transmission path, the fire detector, and the current direction detecting units indicated thereon is displayed on a display of the receiver.

A current normal group including one or a plurality of current direction detecting units in which the current normal direction is detected in the disaster-prevention facility map is di splayed with, for example, green. On the other hand, a current reverse group including one or a plurality of current direction detecting units in which the current reverse direction is detected is displayed with, for example, red, and it is possible to display that a break occurs between the green current normal group and the red current reverse group.

(Effects by At-A-Glance Display of Detected Direction of Current Direction Detecting Unit)

The fire receiver makes an at-a-glance display with information for identifying the current direction detecting units and the current direction detected by the current direction detecting units associated with each other. Thus, when a break occurs in the loop transmission path, for example, the name, address, and current direction of a terminal including the current direction detecting unit are displayed on a display of the receiver, thereby allowing terminals in the current normal direction and terminals in the current reverse direction to be found at a glance and helping identifying the break location.

BRIEF DESCRIPTION OF THE DRAWINGS

FIG. 1 is a descriptive diagram depicting a general outline of a fire notification facility with relays each including a current direction detecting function provided on a loop transmission path.

FIG. 2 is a block diagram depicting an embodiment of each relay including the current direction detecting function of FIG. 1.

FIG. 3 is a block diagram depicting another embodiment of the relay including the current direction detecting function of FIG. 1.

FIG. 4 is a descriptive diagram depicting a current direction flowing through the relays by transmission of an upstream signal from a fire detector when a break fault occurs in the loop transmission path.

FIG. 5 is a descriptive diagram depicting one example of a disaster-prevention facility map displayed on a receiver.

FIG. 6 is a descriptive diagram depicting one example of a break section display by the disaster-prevention facility map.

FIG. 7 is a descriptive diagram depicting a general outline of a fire notification facility with a current direction detecting function provided on a detector base.

FIG. 8 is a block diagram depicting an embodiment of the detector base including the current direction detecting function of FIG. 7.

FIG. 9 is a block diagram depicting an embodiment of a fire detector including a current direction detecting function.

FIG. 10 is a descriptive diagram depicting a conventional fire notification facility with a loop transmission path provided thereto.

BEST MODE FOR CARRYING OUT THE INVENTION

[Fire Notification Facility]

(General Outline of Fire Notification Facility)

FIG. 1 is a descriptive diagram depicting a general outline of a fire notification facility with relays each including a current direction detecting function provided on a loop transmission path. As depicted in FIG. 1, in an administrator room on the first floor of a building with a fire notification facility installed therein or the like, for example, an R-type receiver 10 is installed.

From the receiver 10 to a warning zone, a loop transmission path 12 is drawn using paired signal lines 14*a* and 14*b*.

To the loop transmission path 12, a plurality of fire detectors 18 each having a transmission function with a unique address set thereto are attachably and detachably connected via a detector base 16. Also, to a loop transmission path 12 between the fire detectors 18, a relay 20 is connected, which includes a current direction detecting function and has a transmission function with a unique address set thereto.

The current direction detecting function provided to the relay 20 detects, as a current normal direction, a current direction of a current i indicated by an arrow flowing by transmission of the upstream signal from the fire detector 18 to the loop transmission path 12 in a normal state without a break fault, and also detects a current –i flowing in a direction opposite to the current normal direction as a current reverse direction for transmission to the receiver 10.

Here, the maximum number of addresses set to terminals including the fire detectors 18 and the relays 20 connected to the loop transmission path 12 is assumed as, for example, 255. To the loop transmission path 12, 254 terminals at maximum including fire detectors 18 and the relays 20 can be connected.

Also in FIG. 1, for ease of description, it is assumed that six fire detectors 18 and five relays 20 are connected, the addresses of the fire detectors 18 are A1, A2 . . . A6 from a starting end side of the loop transmission path 12, and the addresses of the relays 20 are A7, A8, . . . A11 from a starting end side.

(Functional Structure of Receiver)

The receiver 10 includes a reception control unit 22, a transmitting unit 23, an operating unit 24, a display unit 25 including a liquid-crystal display and a display light, an alert unit 26, a transfer unit 27, a break monitoring control unit 28, and switching circuit units 30*a* and 30*b*.

The reception control unit 22 is assumed to be a computer circuit or the like including a CPU, a memory, various input/output ports, and so forth. The transmitting unit 23 transmits and receives signals by following a predetermined communication protocol between the fire detectors 18 and the relays 20 connected to the loop transmission path 12.

A downstream signal from the transmitting unit 23 to any fire detector 18 is transmitted in voltage mode. This signal in voltage mode is transmitted as a voltage pulse which changes a line voltage of the loop transmission path 12 between, for example, 18 volts and 30 volts.

By contrast, an upstream signal from any of the fire detectors 18 and the relays 20 to the receiver 10 is transmitted in current mode. In this current mode, a signal current is let flow to the loop transmission path 12 at a timing of bit 1 of transmission data, and the upstream signal is transmitted to the receiver as a so-called current pulse string. Thus, when the fire detector 18 transmits an upstream signal to the receiver 10, the current i flows by a route of (receiver 10 plus side)→(signal line 14*a*)→(fire detector 18)→(signal line 14*b*)→(receiver 10 minus side), and a current normal direction is detected at the relay 20 positioned therebetween.

Fire monitoring control by the reception control unit 22 of the receiver 10 is as follows.

During normal monitoring, the reception control unit 22 instructs the transmitting unit 23 at every constant cycle to transmit broadcast collective AD conversion signals including collective AD conversion commands. The fire detector 18 receiving this collective AD conversion signal detects and retains smoke concentration or temperature as sensor data. Subsequently, the reception control unit 22 transmits call signals including polling commands which sequentially specify terminal addresses.

Upon receiving a call signal with an address matching its self address, the fire detector 18 transmits to the receiver 10 a response signal including sensor data retained at that time. Upon detecting fire, the fire detector 18 transmits to the receiver 10 a fire interrupt signal. Upon receiving the fire interrupt signal via the transmitting unit 23, the reception control unit transmits a group search command signal to identify a group including the fire detector 18 which detects fire and, subsequently, transmits an in-group search command signal to identify the address of the fire detector 18 which detects fire and display the fire-occurring address and collect fire data from the identified fire detector for monitoring.

This point similarly applies to the relays 20. The relay 20 receiving the collective AD conversion signal from the receiver 10 detects and retains a current normal direction or current reverse direction based on the current direction detected at that time and, subsequently, upon receiving the transmitted call signal including a polling command which specifies the self address, transmits to the receiver 10 a response signal including the current normal direction or current reverse direction retained at that time.

In this manner, with each fire detector 18 and the relay 20 receiving a call signal, with its self address specified, regularly transmitted from the receiver 10 and transmitting a response signal, upstream signal transmission is performed substantially continuously on the loop transmission path 12. This causes the current i in the current normal direction, and the relays 20 always detects the current normal direction and transmits a response signal to the receiver 10.

The break monitoring control unit 28 detects and monitors a signal voltage acquired at the termination of the loop transmission path 12.

When a break occurs in the loop transmission path 12, the signal voltage is broken and cannot be detected, and thus a break is detected. With ON activation of the switching circuit units 30*a* and 30*b* using relay contacts and switch elements, the transmitting unit 23 is connected to the termination of the loop transmission path 12. With parallel signal transmission and reception being performed to and from a transmission path between both ends and the break position of the loop transmission path 12, recovery from the break fault is performed.

In this manner, with ON activation of the switching circuit units 30*a* and 30*b* by the break monitoring control unit 28 to start performing parallel signal transmission and reception to and from the transmission path between both ends and the break position of the loop transmission path 12, when the fire detectors 18 connected between the termination and the break position of the loop transmission path 12 each transmit an upstream signal to the receiver 10, the current –i flows in a direction opposite to that before the break on a route (receiver 10 plus side)→(signal line 14*b*)→(fire detector 18)→(signal line 14*a*)→(receiver 10 minus side).

At the relays 20 positioned therebetween, a current reverse direction is detected and is transmitted to the receiver 10.

The reception control unit 22 is provided with a break section determining unit 32 as a function to be achieved with program execution by the CPU. When a break occurs in the loop transmission path 12, the break section determining unit 32 performs control of determining a section where the current normal direction detected at the relays 20 changes to the current reverse direction as a break section and notifying as such.

Also, as a notification of a break section by the break section determining unit 32, when a break fault is detected, control is performed such that a disaster-prevention facility map where the receiver 10, the loop transmission path 12, the fire detectors 18, and the relays 20 are indicated is displayed on the liquid-crystal display provided to the display unit 25 and a current normal group including the relays 20 where the current normal direction is detected and a current reverse group including other relays 20 where the reverse current direction is detected are displayed and color-coded with different predetermined colors, causing the occurrence of a break between the color-coded current normal group and current reverse group to be displayed.

[Relay]

FIG. 2 is a block diagram depicting an embodiment of each relay including the current direction detecting function of FIG. 1. As depicted in FIG. 2, the relay 20 is configured of a control unit 34, a transmitting unit 36, a current direction detecting unit 38, a current detection resistor 40, an isolation circuit unit 42, and switch circuit units 44*a* and 44*b*, and operates as receiving power supply from signal lines 14*a* and 14*b* or power supply from a dedicated power supply line.

The current direction detecting unit 38 detects a voltage occurring across both ends by a current flowing through the current detection resistor 40 with a small resistance value inserted and connected to the signal line 14*a*. At normal time without a break on the loop transmission path 12, the normal current i indicated by a solid line flows. When a downstream signal transmitted from the termination side of the loop transmission path 12 due to a break is received, the reverse current −i indicated by a dotted line flows. Note that while the normal current i or the reverse current −i at the current detection resistor 40 flows by transmission of the upstream signal by any fire detector 18, either the normal current i or the reverse current −i supplied to the transmitting unit 36 and so forth further flows by transmission of the upstream signal by the transmitting unit 36 of any relay 20.

Since the polarity of the current detection voltage occurring across both ends of the current detection resistor 40 is reversed between the case where the normal current i flows and the case where the reverse current −i flows through the current detection resistor 40, the current direction detecting unit 38 detects a current normal direction when a current detection voltage with a polarity by the normal current i is acquired, and detects a current reverse direction when a current detection voltage with a reverse polarity by the reverse current −i is acquired.

Here, the relay 20 of FIG. 2 is configured to supply a power supply voltage Vcc to circuit blocks such as the control unit 34 and the transmitting unit 36 to the current direction detecting unit 38 from an upstream side of the current normal direction. When the loop transmission path 12 is broken on a downstream side of the relay 20 and no fire detector 18 is connected between the relay 20 and the break location, the normal current i does not flow through the current detection resistor 40, and the current detection voltage is 0 volt. Also in this case, the current direction detecting unit 38 detects a current detection voltage of 0 volt as being in a current normal direction.

By contrast, as depicted in FIG. 3, the configuration may be such that the power supply voltage Vcc is supplied to the circuit blocks such as the control unit 34 and the transmitting unit 36 to the current direction detecting unit 38 from a downstream side of the current normal direction.

However, when the loop transmission path 12 is broken on an upstream side of the relay 20 and no fire detector 18 is connected between the relay 20 and the break location, the reverse current −i does not flow through the current detection resistor 40, and the current detection voltage is 0 volt.

Also in this case, the current direction detecting unit 38 detects a current detection voltage of 0 volt as being in a current reverse direction.

Note that the relay 20 of FIG. 3 is the same as the relay 20 of FIG. 2 except that it connects the transmitting unit 36 to the loop transmission path 12 on a downstream side of the current detection resistor 40 to take out the power supply voltage Vcc.

In this manner, when the control unit 34 and others are away from the current direction detecting unit 38 with respect to a break direction and no terminal is arranged between the break location and the relay, the current direction detecting unit 38 detects 0 volt. However, with the structure as described above, it can be determined on which of the upstream side and the downstream side of the relay 20 the break location occurs when the break detection voltage of 0 volt is detected.

The transmitting unit 36 receives a downstream signal transmitted in voltage mode due to a change in line voltage from the receiver 10, and transmits to the receiver 10 an upstream signal in current mode due to a change in line current.

The control unit 34 performs control of, when receiving a collective AD conversion signal from the receiver 10 via the transmitting unit 36, retaining the current normal direction or the current reverse direction detected at the current direction detecting unit 38 at that time and, subsequently, when receiving a call signal including a polling command with its self address specified, transmitting a response signal including the current normal direction or the current reverse direction retained at that time to the receiver 10. An interrupt signal may be sent to the receiver 10 at the time of current direction reversal, and the receiver may sequentially perform polling on addresses from which an interrupt signal is received to communicate with a relay in a reverse direction.

Also, when determining an overcurrent due to a short-circuit fault in the loop transmission path 12 from the detection voltage of the current direction detecting unit 38, the control unit 34 performs control, as a short-circuit isolator, of instructing the isolation circuit unit 42 to turn off the switch circuit units 44*a* and 44*b* and the switch circuit units 45*a* and 45*b*, which are ON in a normal state, isolate the loop transmission path 12 where the short-circuit fault occurs.

Note that the relay 20 of the present embodiment is only required to achieve at least the current direction detecting function and, for this, includes the control unit 34, the transmitting unit 36, the current direction detecting unit 38, and the current detection resistor 40 and is not necessarily required to be provided with a short-circuit isolator by the isolation circuit unit 42 and the switch circuit units 44*a* and 44*b*.

Furthermore, it is desirable to provide the relay 20 with a display unit such as an LED display which displays the current direction detected by the current direction detecting unit 38. When a display unit indicating a current direction is provided to the relay 20, at the time of occurrence of a break, an operator can grasp a section in which the current normal direction is changed to the current reverse direction as a break section by advancing in a wiring direction while checking the display unit of the relay 20.

[Operation when Loop Line Breaks]

FIG. 4 is a descriptive diagram depicting a current direction flowing through the relays by transmission of an upstream signal from the fire detector when a break fault occurs in the loop transmission path.

As depicted in FIG. 4, if it is assumed that a break 31 occurs in the loop transmission path 12 between the fire detector 18 at the address A3 and the fire detector 18 at the address A4, the break monitoring control unit 28 of the receiver 10 detects that a line voltage at the termination of the loop transmission path 12 is broken by the break 31 and turns the switching circuit units 30*a* and 30*b* ON, and connects the transmitting unit 23 to the termination of the loop transmission path 12. Thus, with respect to the location of occurrence of the break 31, the state becomes such that downstream signals outputted from the transmitting unit 23 are transmitted from both sides, the starting end and the termination, of the loop transmission path 12.

With this, like before the break, the fire detectors 18 at the addresses A1 to A3 and the relays 20 at the addresses A7 to A9 connected between the starting end of the receiver 10 and the location of occurrence of the break 31 each receive a downstream signal from the starting end side of the loop transmission path 12 and transmit an upstream signal to the starting end side of the loop transmission path 12, and the relays 20 at the addresses A7 and A8 each detect a current normal direction based on the normal current i indicated by a solid arrow for transmission to the receiver 10.

Here, no current by transmission of the upstream signal from the fire detector 18 flows through the relay 20 at the address A9, and the current detection voltage is 0 volt. However, since this is detected as being in a current normal direction, three relays 20 at the addresses A7 to A9 detect a current normal direction for transmission to the receiver 10.

By contrast, with the switching circuit units 30*a* and 30*b* turned ON by the break monitoring control unit 28, the fire detectors 18 at the addresses A4 to A6 and the relays 20 at the addresses A10 and A11 connected between the termination of the loop transmission path 12 and the location of occurrence of the break 31 each receive, conversely to the case before the break, a downstream signal from the termination side of the loop transmission path 12 and transmit an upstream signal to the termination side of the loop transmission path 12.

The relays 20 at the addresses A10 and A11 each detect, based on the reverse current −i indicated by a dotted arrow, a current reverse direction for transmission to the receiver 10.

The break section determining unit 32 provided in the receiver 10 determines, as a break section, an address section in which a current direction corresponding to the address of the relay 20 is changed from the current normal direction to the current reverse direction.

Here, if it is assumed that the current normal direction is (+) and the current reverse direction is (−), (A7 A8 A9 A10 A11)=(+ + + − −), and the current normal direction is changed to the current reverse direction between the address A9 and the address A10. Thus, it is possible to determine a section between the relay 20 at the address A9 and the relay 20 at the address A10 as a break section of the loop transmission path 12 and make a notification as such.

[Display of Break Section]

FIG. 5 is a descriptive diagram depicting one example of a disaster-prevention facility map displayed on the receiver. As depicted in FIG. 5, on a disaster-prevention facility map screen 48 displayed on the liquid-crystal display provided to the display unit 25 of the receiver 10 depicted in FIG. 1, for example, a map on the third floor in an A unit is displayed. The loop transmission path 12 indicated by a dotted line is drawn out from the receiver 10 to the inside of the facility.

To the loop transmission path 12, fire detectors indicated by square marks and relays indicated by triangular marks are connected. To the fire detectors, addresses A1 to A13 are set from the starting end toward the termination. To the relays, addresses A14 to A25 are set from the starting end toward the termination. Also, at the fire detectors and the relays, oval markers indicating addresses are displayed.

FIG. 6 is a descriptive diagram depicting one example of a break section display by the disaster-prevention facility map, depicting a display when a break 50 occurs in the loop transmission path 12 between the relay at the address A14 and the relay at the address A15.

When the break 50 occurs, it is determined at the break section determining unit 32 that the relay at the address A13 positioned between the starting end side of the loop transmission path 12 and the location of occurrence of the break 50 belongs to the current normal group and the relays at the addresses A14 to A25 positioned between the termination side of the loop transmission path 12 and the location of occurrence of the break 50 belong to the current reverse group.

Thus, the break section determining unit 32 determines a section between the relay at the address A14 and the relay at the address A15 as a break section, causes the relay at the address A14 belonging to the current normal group and the fire detector at the address A1 to be displayed as being assigned with, for example, blue, causes the relays at the addresses A15 to A25 belonging to the current reverse group and the fire detectors at the addresses A2 to A13 to be displayed as being assigned with, for example, red, and causes a partition interposed between the blue current normal group and the red current reverse group as a break section by color coding.

Also, on an upper part of the screen, "BREAK FAULT OCCURRING, A14-A15 SECTION" is displayed as a break fault display 48. Furthermore, as for the break section of the loop transmission path 12, a break mark as a cross mark indicating the break 50 is displayed.

With the display on the break section using the disaster-prevention facility map as described above, a disaster-prevention administrator or the like can easily and reliably know the position on the loop transmission path 12 in the facility where a break fault occurs and appropriately and quickly react, such as replacing and repairing the loop transmission path due to the break fault.

[Detector Base including Current Direction Detecting Function]

FIG. 7 is a descriptive diagram depicting a general outline of a fire notification facility with a current direction detecting function provided on a detector base, and FIG. 8 is a block diagram depicting an embodiment of the detector base including the current direction detecting function of FIG. 7.

As depicted in FIG. 7, in the present embodiment, each detector base 16 which attachably and detachably connects the fire detector 18 to the loop transmission path 12 is provided with the function of the current direction detecting unit 38, and the other structures and functions are the same as those of the embodiment of FIG. 1.

As depicted in FIG. 8, the detector base 16 has a cross-connection of the signal lines 14*a* and 14*b* of the loop transmission path 12. To the signal lines 14*a* and 14*b*, the fire detector 18 is attachably and detachably connected, electrically and mechanically, with fitting pieces of hardware 52*a* and 52*b*.

The detector base 16 is provided with the control unit 34, the transmitting unit 36, the current direction detecting unit 38, and the current detection resistor 40, and operates as receiving power supply from the signal lines 14*a* and 14*b* or power supply from a dedicated power supply line.

Since the polarity of the current detection voltage occurring across both ends of the current detection resistor 40 is reversed between the case where the normal current i flows and the case where the reverse current −i flows through the current detection resistor 40, the current direction detecting unit 38 detects a current normal direction when a current detection voltage with a polarity by the normal current i or a current detection voltage of 0 volt is acquired, and detects a current reverse direction when a current detection voltage with a reverse polarity by the reverse current −i is acquired.

The transmitting unit 36 receives a downstream signal transmitted due to a change in line voltage from the receiver 10, and transmits an upstream signal to the receiver 10 due to a change in line current.

The control unit 34 performs control of, when receiving a collective AD conversion signal from the receiver 10 via the transmitting unit 36, retaining the current normal direction or the current reverse direction detected at the current direction detecting unit 38 at that time and, subsequently, when receiving a call signal including a polling command with its self address specified, transmitting a response signal including the current normal direction or the current reverse direction retained at that time to the receiver 10.

In this manner, by providing the detector base 16 with the control unit 34, the transmitting unit 36, the current direction detecting unit 38, and the current detection resistor 40, compared with the case as in FIG. 1 in which the relay 20 is connected to the loop transmission path 12 between the fire detectors 18, the facility structure is simplified. Similarly, for the occurrence of a break fault in the loop transmission path 12, the receiver 10 can determine a break section and inform as such.

[Fire Detector including Current Direction Detecting Function]

FIG. 9 is a block diagram depicting an embodiment of a fire detector including a current direction detecting function. As depicted in FIG. 9, in the present embodiment, the fire detector 18 attachably and detachably provided to the loop transmission path 12 via the detector base 16 is provided with the control unit 34, the transmitting unit 36, the current direction detecting unit 38, the current detection resistor 40, and a sensor unit 60, and operates as receiving power supply from the signal lines 14*a* and 14*b* or power supply from a dedicated power supply line.

The sensor unit 60 has, for example, a known scattered-light-type smoke detection structure, intermittently light-emission driving a light-emitting unit using an infrared LED with a predetermined period, amplifying a light-receiving signal of the scatted light received at a light-receiving unit such as a photodiode, and outputting a smoke-concentration detection signal. Note that the sensor unit 60 may be provided with a temperature detecting unit in place of a smoke-detecting unit. As a temperature detecting element, the temperature detecting unit uses, for example, a thermistor, and, in this case, outputs a temperature detection signal as a voltage signal corresponding to a change of a resistance value due to temperature.

The control unit 34 includes a fire detecting function and a current direction detecting function. The fire detecting function of the control unit 34 is the same as the operation described for the fire detector 18 of FIG. 1, receiving a collective AD conversion signal from the receiver, AD converting and retaining sensor data and, subsequently, in response to a call signal including a polling command with its self address specified from the receiver, transmitting a response signal including the sensor data. Also, when, for example, a smoke-concentration detection signal outputted from the sensor unit 60 exceeds a predetermined fire threshold concentration, a fire is determined, and a fire interrupt signal is transmitted to the loop transmission path 12.

The current direction detecting unit 38 detects a current normal direction when a current detection voltage with a polarity by the normal current i or a current detection voltage of 0 volt is acquired at the current detection resistor 40, and detects a current reverse direction when a current detection voltage with a reverse polarity by the reverse current −i is acquired.

The transmitting unit 36 receives a downstream signal transmitted due to a change in line voltage from the receiver 10, and transmits an upstream signal to the receiver 10 due to a change in line current.

The control unit 34 performs control of, when receiving a collective AD conversion signal from the receiver 10 via the transmitting unit 36, retaining the current normal direction or the current reverse direction detected at the current direction detecting unit 38 at that time and, subsequently, when receiving a call signal including a polling command with its self address specified, transmitting a response signal including the current normal direction or the current reverse direction retained at that time to the receiver 10.

In this manner, by providing the fire detector 18 with the control unit 34, the transmitting unit 36, the current direction detecting unit 38, and the current detection resistor 40, the control unit and the transmitting unit already provided to the fire detector 18 can be used they are as the control unit 34 and the transmitting unit 36. Compared with the case in which the current direction detecting unit is provided to the detector base 16, the facility structure is further simplified. For the occurrence of a break fault in the loop transmission path 12, the receiver 12 can determine a break section and inform as such.

[Modification Examples of Present Invention]

While the relay including the current direction detecting function is connected between the fire detectors in the above-described embodiments, they are not limited by this, and the relay may be connected among a plurality of fire detectors.

Also, while a loop wiring is drawn out from the receiver in the above-described embodiments, they can similarly apply to a loop wiring drawn out from a relay connected to the receiver. The relay in this case has a structure of the receiver 10 of FIG. 1 with the operating unit 24, the display unit 25, the alert unit 26, and the transfer unit 27 removed therefrom, and fire monitoring and control are basically the same as that of the receiver 10.

Upon detecting a fire, the relay transmits fire detection information to the receiver 10 to cause a fire alert to be outputted, and performs necessary control upon receiving an instruction by operation of the receiver 10.

Furthermore, while a break section is indicated by displaying the current normal group and the current reverse group by color coding on the disaster-prevention facility map when a break fault occurs in the loop transmission path in the above-described embodiments, the break section may be indicated by displaying the break section with a specific color different from display colors of other sections.

Still further, in addition to the receiver, display may be made at a distributed display terminal.

Yet still further, before causing a current to flow from a reverse direction, the receiver may acquire and store terminal information regarding the presence or absence of a response.

Yet still further, the fire receiver may make an at-a-glance display with information for identifying the current direction detecting units and the current direction detected by the current direction detecting units associated with each other.

While a break section display is suitable because a break location can be grasped at a glance, a correspondence between a wiring diagram and a map is required, and implementation may be difficult.

In the at-a-glance display, terminals in the current normal direction and terminals in the current reverse direction can be known at a glance while the correspondence between the wiring diagram and the map is not required, which can help identify the break location.

Yet still further, while the fire notification facility with the R-type fire detectors connected via the loop transmission path from the R-type receiver is taken as an example in the above-described embodiments, they can similarly apply to a fire notification facility in which addresses are set to a loop-type detector line drawn out from a P-type receiver and addressable fire detectors each including a transmitting function are connected.

Yet still further, the present invention includes appropriate modifications without impairing its objects and advantages and, furthermore, is not limited by numerical values indicated in the above-described embodiments.

DESCRIPTION OF REFERENCE NUMERALS

10: receiver
12: loop transmission path
14*a*, 14*b*: signal line
16: detector base
18: fire detector
20: relay
22: reception control unit
23: transmitting unit
28: break monitoring control unit
30*a*, 30*b*: switching circuit unit
32: break section determining unit
34: control unit
38: current direction detecting unit
40: current detection resistor
42: isolation circuit unit
44*a*, 44*b*: switch circuit unit
46: disaster-prevention facility map screen
48: break fault display
50: break section display

The invention claimed is:

1. A fire notification facility comprising:

a receiver or a relay connected to the receiver;

a loop transmission path connected in a loop shape to the receiver or the relay;

a plurality of fire detectors provided to the loop transmission path;

a break monitoring control unit connected to a terminating end of the loop transmission path, a transmitting unit of the receiver or the relay being connected to a starting end of the loop transmission path and configured to transmit a signal to at least one of the plurality of fire detectors to monitor fire when the loop transmission path is normal, and the break monitoring control unit being configured to connect the terminating end of the loop transmission path to the transmitting unit by a switching unit for transmission of a signal from both the terminating end of the loop transmission path and the starting end of the loop transmission path to at least one of the plurality of fire detectors to monitor fire when a break occurs in the loop transmission path;

a plurality of current direction detecting units connected to the loop transmission path, each of the plurality of current direction detecting units having a unique address set thereto, and being configured to detect a current direction flowing through the loop transmission path in a predetermined direction as a current normal direction and detect a current direction flowing opposite to the current normal direction as a current reverse direction; and a break section determining unit provided to the receiver or the relay, the break section determining unit being configured to: (i) determine, as a break section, a section in which the current normal direction detected at the plurality of current direction detecting units has changed to the current reverse direction when a break occurs in the loop transmission path; and (ii) notify of the break section.

2. The fire notification facility according to claim 1, wherein each of the plurality of current direction detecting units is configured to detect:

a current detection voltage by a current flowing through a current detection resistor connected in series to the loop transmission path;

the current normal direction when the current detection voltage is a plus voltage or zero volt when a power supply voltage is supplied to the current direction detecting unit from an upstream side of the current detection resistor; and the current reverse direction when the current detection voltage is a minus voltage or zero volt when the power supply voltage is supplied to the current direction detecting unit from a downstream side of the current detection resistor.

3. The fire notification facility according to claim 1, wherein:

the relay is one of a plurality of relays connected to the loop transmission path among the plurality of fire detectors; and the plurality of current direction detecting units are provided to the plurality of relays, respectively.

4. The fire notification facility according to claim 1, wherein:

the plurality of fire detectors are attachably and detachably connected to the loop transmission path by a plurality of detector bases, respectively; and the plurality of current direction detecting units are provided to the plurality of detector bases, respectively.

5. The fire notification facility according to claim 1, wherein the plurality of current direction detecting units are provided to the plurality of fire detectors, respectively.

6. The fire notification facility according to claim 1, wherein each of the plurality of current direction detecting units includes a display unit configured to display the current direction.

7. The fire notification facility according to claim 1, wherein:

the receiver is configured to cause a screen display of a disaster-prevention facility map where arrangement of the loop transmission path and the plurality of current direction detecting units are displayed; and the break section determining unit is configured to cause a current normal group including at least one of the plurality of current direction detecting units in which the current normal direction is detected and a current reverse group including at least one of the plurality of current direction detecting units in which the current reverse direction is detected to be displayed by color coding with different predetermined colors, and cause an occurrence of a break between the current normal group and the current reverse group which have been color-coded to be displayed.

8. The fire notification facility according to claim 1, wherein the receiver is configured to make an at-a-glance display with information for identifying the plurality of current direction detecting units and the current direction detected by the plurality of current direction detecting units associated with each other.

9. The fire notification facility according to claim 2, wherein each of the plurality of current direction detecting units includes a display unit configured to display the current direction.

10. The fire notification facility according to claim 3, wherein each of the plurality of current direction detecting units includes a display unit configured to display the current direction.

11. The fire notification facility according to claim 4, wherein each of the plurality of current direction detecting units includes a display unit configured to display the current direction.

* * * * *